US008319587B2

(12) United States Patent
Durand et al.

(10) Patent No.: US 8,319,587 B2
(45) Date of Patent: Nov. 27, 2012

(54) DEVICE FOR SECTIONING AN ELECTRICAL CIRCUIT AND A SYSTEM FOR DISTRIBUTING ELECTRICAL ENERGY INCLUDING THE SECTIONING DEVICE

(75) Inventors: Jean-Marc Durand, Poueyferre (FR); Jérémy Delteil, Tarbes (FR)

(73) Assignee: Alstom Transport SA, Levallois-Perret (FR)

( * ) Notice: Subject to any disclaimer, the term of this patent is extended or adjusted under 35 U.S.C. 154(b) by 310 days.

(21) Appl. No.: 12/627,973

(22) Filed: Nov. 30, 2009

(65) Prior Publication Data

US 2010/0134223 A1 Jun. 3, 2010

(30) Foreign Application Priority Data

Nov. 28, 2008 (FR) ..... 08 58080

(51) Int. Cl.
*H01H 13/04* (2006.01)

(52) U.S. Cl. ..... 335/202; 335/132

(58) Field of Classification Search ..... 335/202
See application file for complete search history.

(56) References Cited

U.S. PATENT DOCUMENTS 4,506,242 A * 3/1985 Karpe et al. ..... 335/120
4,754,362 A 6/1988 Beller
5,198,789 A * 3/1993 Taylor ..... 335/132
7,049,912 B2 * 5/2006 Bataille et al. ..... 335/132
2010/0127805 A1 5/2010 Bollinger et al.

FOREIGN PATENT DOCUMENTS

| | | | |
|---|---|---|---|
| DE | 2742775 | A1 | 3/1979 |
| DE | 102007017516 | B3 | 10/2008 |
| EP | 0237296 | A2 | 9/1987 |
| EP | 0479694 | | 4/1992 |
| GB | 2207810 | A | 2/1989 |
| GB | 2357374 | A | 6/2001 |

* cited by examiner

*Primary Examiner* — Mohamad Musleh
*Assistant Examiner* — Lisa Homza
(74) *Attorney, Agent, or Firm* — Davidson, Davidson & Kappel, LLC

(57) ABSTRACT

A device for sectioning an electrical circuit is provided. The device includes a housing having two main sectioning terminals and, in the housing, a first member for sectioning a first electrical connection between the two main sectioning terminals, an automatic control, under the action of an electrical signal, of the first sectioning member from the closed position to the open position thereof, and a manual control member for resetting the first sectioning member from the open position to the closed position thereof. The device also includes, in the housing, two secondary sectioning terminals and a second sectioning member movable between a position for opening and a position for closing a second electrical connection between the two secondary sectioning terminals, the second sectioning member being coupled to the first sectioning member, commutation of the first sectioning member bringing about commutation of the second sectioning member.

9 Claims, 3 Drawing Sheets

DEVICE FOR SECTIONING AN ELECTRICAL CIRCUIT AND A SYSTEM FOR DISTRIBUTING ELECTRICAL ENERGY INCLUDING THE SECTIONING DEVICE

This claims priority to FR 08 58080 filed on Nov. 28, 2008 and hereby incorporated by reference herein.

The present invention relates to a device for sectioning an electrical circuit.

The invention also relates to a system for supplying electrical power to at least one electrically conductive rail which is capable of supplying electrical current to a rail vehicle.

BACKGROUND OF THE INVENTION

Devices for sectioning an electrical circuit are used in order to open or close a connection of that electrical circuit, and allow a minimum physical distance to be ensured between the first sectioning member and the corresponding sectioning terminals when the circuit is open. Sectioning devices are used, for example, in units for distributing electrical energy for rail vehicles.

Patent Application EPO479694A1 discloses a sectioning device. The first sectioning member is a movable bar which is composed of insulating material and which is provided with electrical contacts. The automatic control means comprise an electromagnetic switch comprising a metal plate which is fixedly joined to a movable sectioning bar in terms of translation. The manual resetting control member is a lever which is mounted so as to be able to move in rotation about an axle which is fixedly joined to the housing at one of the ends thereof and which is connected to the movable bar.

However, such a sectioning device involves risks of electrocution upon contact with the main sectioning terminals when the circuit is open, that is to say, when the first sectioning member is in the open position. Those risks are even more pronounced because the resetting of the sectioning device is manual.

SUMMARY OF THE INVENTION

An object of the invention is to provide a device for sectioning an electrical circuit which reduces the risks of electrocution upon contact with the main sectioning terminals when the first sectioning member is in the open position.

The present invention provides a sectioning device including, in the housing, two secondary sectioning terminals and a second sectioning member which is movable between a position for opening and a position for closing a second electrical connection between the two secondary sectioning terminals, the second sectioning member being coupled to the first sectioning member, commutation of the first sectioning member bringing about commutation of the second sectioning member.

According to other preferred embodiments, the sectioning device may include one or more of the following features, taken alone or in accordance with any technically possible combination:

the second sectioning member is mechanically coupled to the first sectioning member; commutation of the first sectioning member from the closed position to the open position thereof brings about predetermined commutation of the second sectioning member from the open position to the closed position thereof;

the automatic control means comprise a movable magnetized plate which is fixedly joined to the first sectioning member, an electromagnetic winding which is fixedly joined to the housing and which is connected to two control terminals which are carried by the housing and which is intended to keep the first sectioning member in a closed position in the absence of any electrical current between the control terminals, and a return spring which is urged between the first sectioning member and the housing and which is intended to return the first sectioning member into an open position in the presence, between the control terminals, of an electrical release current, producing a magnetic field in the winding for repelling the movable magnetized plate;

the manual control member comprises a rod for pressing on the first sectioning member so as to move it from the open position to the closed position, the pressing rod being accessible from outside the housing;

the pressing rod is arranged between the two secondary sectioning terminals;

the device comprises an auxiliary terminal which is carried by the housing and which is connected by a conductive braid to the second sectioning member; and the device comprises a sensor for reading the position of the first sectioning member.

The present invention also provides a system for supplying electrical power, characterized in that the sectioning device is as defined above.

According to another embodiment, the electrical power supply system comprises the following feature:

the system is intended to supply electrical power to at least two electrically conductive rails, the sectioning device is as defined above, the auxiliary terminal is connected to electrical earth and the grounding circuit connects each of the conductive rails to a corresponding secondary terminal in such a manner that the sectioning of the electrical power supply circuit, by means of commutation of the first sectioning member from its position for closing to its position for opening the first electrical connection, brings about connection of each of the conductive rails to electrical earth.

BRIEF DESCRIPTION OF THE DRAWINGS

Those features and advantages of the invention will be appreciated from a reading of the following description which is given purely by way of example and with reference to the appended drawings, in which.

DETAILED DESCRIPTION

Figure 1:
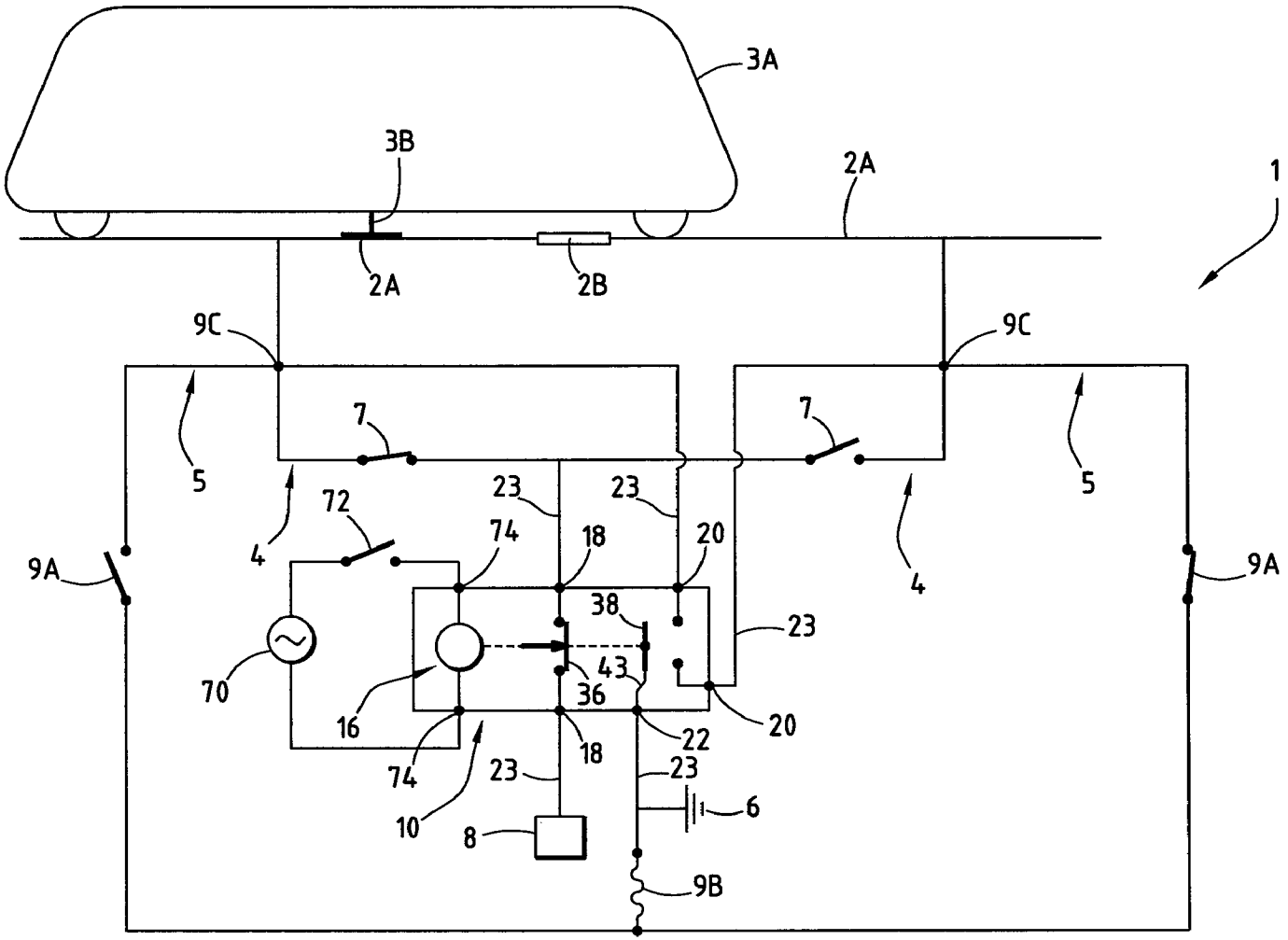
FIG. 1 is a schematic illustration of an electrical power supply system for two electrically conductive rails according to the invention.

FIG. 1 illustrates a system 1 for supplying electrical power to two electrically conductive rails 2A which are connected to each other by an insulating portion 2B. The electrically conductive rails 2A are capable of providing electrical current to a rail vehicle 3A by means of an electrically conductive runner 3B. The supply system 1 comprises a circuit 4 for supplying electrical power to a conductive rail 2A and a circuit 5 for connecting to electrical ground 6 the other conductive rail 2A or the two conductive rails 2A when no conductive rail 2A is supplied with electrical power by the supply circuit 4.

The supply circuit 4 comprises a first switch 7 for each conductive rail 2A and a current source 8. The grounding circuit 5 comprises a second switch 9A for each conductive rail 2A and a fuse 9B for connection to electrical ground 6. The supply circuit 4 and the grounding circuit 5 comprise common connection points 9C.

The supply system 1 comprises a device 10 for sectioning the supply circuit 4.

Figure 2:
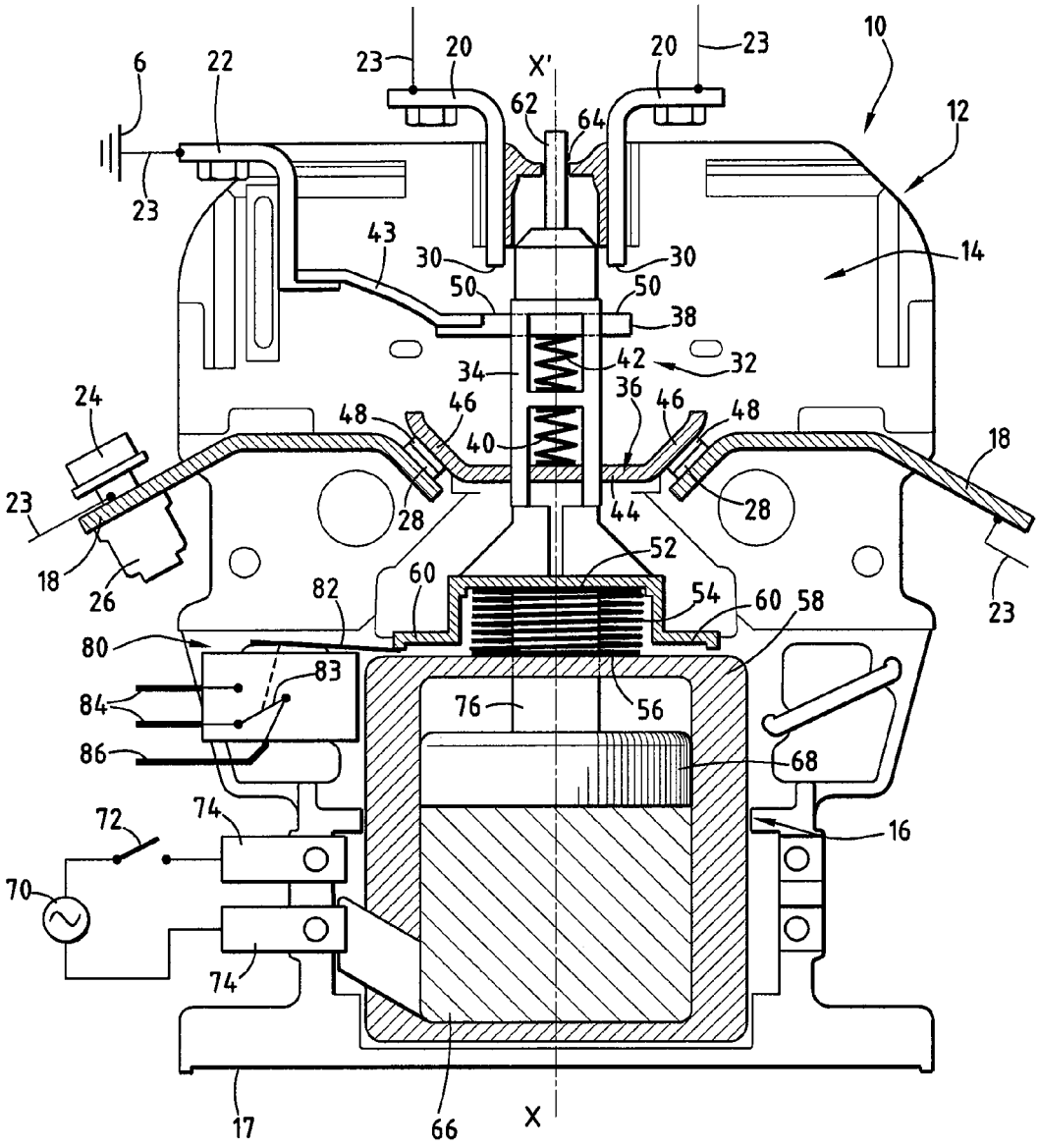
FIG. 2 is a cross-section of an sectioning device which is connected in a unit for distributing electrical energy according to the invention, when a first electrical connection is in the closed position.
Figure 3:
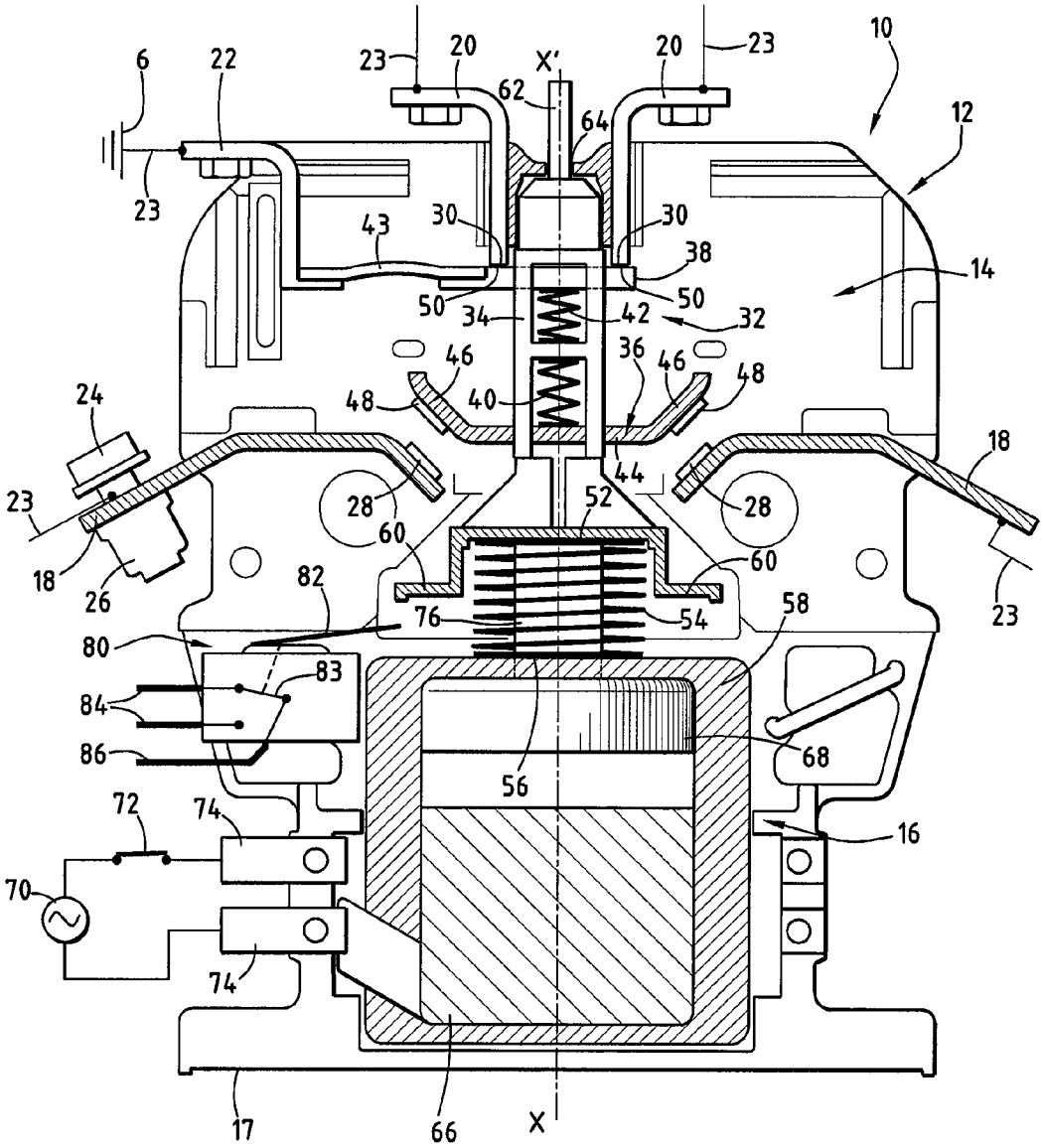
FIG. 3 is a view similar to that of FIG. 2 when the first electrical connection is in the open position.

The sectioning device 10 illustrated in FIG. 2 comprises, in a housing 12, a connection module 14 and an actuator 16 which is capable of controlling the commutation of the connection module 14 from a first state to a second state. The first state is illustrated in FIG. 2 and the second state is illustrated in FIG. 3.

The housing 12 comprises a base plate 17 which is intended to be fixed to a support, which is not illustrated.

The connection module 14 comprises two main sectioning terminals 18, two secondary sectioning terminals 20 and an auxiliary terminal 22. The supply circuit 4 is capable of connecting one of the main sectioning terminals 18 to the two first switches 7 and the other main terminal 18 to the current source 8. (FIG. 1). The grounding circuit 5 is capable of connecting, at one side, each conductive rail 2A and each second switch 9A to a corresponding secondary terminal 20 and, at the other side, the auxiliary terminal 22 to electrical ground 6.

Each terminal 18, 20, 22 is connected by an electrical connection cable 23 to the corresponding circuit 4, 5. The connection cables 23 are, for example, provided at one of the ends thereof with a socket (not illustrated) which is clamped against a terminal 18, 20, 22 by means of a screw 24 and a nut 26.

In the housing 12, each main terminal 18 is fixedly joined to a first contact 28 and each secondary terminal 20 comprises an end forming a second contact 30, respectively.

The two main terminals 18 and the two first contacts 28 are arranged symmetrically relative to an axis of symmetry X-X' which is perpendicular to the base plate 17. Similarly, the two secondary terminals 20 and the two second contacts 30 are symmetrical relative to the axis X-X'. In the embodiment of FIG. 2, the second contacts 30 are coplanar.

Movable equipment 32 is mounted so as to be slidingly movable along the axis X-X' between the first fixed contacts 28, on the one hand, and the second fixed contacts 30, on the other hand, under the control of the actuator 16.

The movable equipment 32 comprises an insulating member 34 which carries a first conductive sectioning plate 36 and a second conductive sectioning plate 38. In greater detail, the first plate 36 is coupled to the insulating member 34 by a first contact spring 40 and the second plate 38 is coupled to the insulating member 34 by a second contact spring 42. The second plate 38 is electrically connected to the auxiliary terminal 22 by means of a conductive braid 43.

The first plate 36 and the second plate 38 extend substantially transversely relative to the axis X-X'. Each plate 36, 38 is axially movable relative to the insulating member 34. The plates 36, 38 are movable inside rectangular slots which extend in accordance with the axis X-X' and which are provided in the insulating member 34.

The first plate 36 is movable relative to the two main terminals 18 between a position for closing and a position for opening a first electrical connection between the two main terminals 18. The first plate 36 comprises a web 44 which is extended at each of the ends thereof by an inclined flange 46. Each flange 46 of the first plate is fixedly joined to a third contact 48. Each third contact 48 is capable, when the first plate 36 is in the closed position, of abutting against a first contact 28 and thereby of ensuring the closure of the first electrical connection between the two main terminals 18, as illustrated in FIG. 2. Each third contact 48 is intended, when the first plate 36 is in an open position, to be spaced apart from the first contact 28 and thereby to ensure the opening of the first electrical connection, as illustrated in FIG. 3.

The second conductive plate 38 is movable relative to the two secondary terminals 20 between a position for opening and a position for closing a second electrical connection between the two secondary terminals 20. The second plate 38 is substantially planar and has, on one face, two zones which form two fourth contacts 50, respectively. The fourth contacts are coplanar. Each fourth contact 50 is intended, when the second plate 38 is in the open position, to be spaced apart from a second contact 30 and thereby to ensure the opening of the second electrical connection, as illustrated in FIG. 2. Each fourth contact 50 is capable, when the second plate 38 is in the closed position, of abutting against a second contact 30 and thereby of ensuring the closure of the second electrical connection, as illustrated in FIG. 3.

The first contact spring 40 is capable of resiliently urging the first plate 36 in the direction of the main terminals 18 in order to ensure contact between the third contacts 48 and the first contacts 28, respectively. The second contact spring 42 is capable of resiliently urging the second plate 38 against the secondary terminals 20 in order to ensure contact between the fourth contacts 50 and the second contacts 30, respectively.

The closed position of the first plate 36 and the open position of the second plate 38 correspond to the first state of the connection module 14, illustrated in FIG. 2. The open position of the first plate 36 and the closed position of the second plate 38 correspond to the second state of the connection module 14, illustrated in FIG. 3.

At its end directed towards the actuator 16, the movable equipment 32 has a transverse stop surface 52. A second resilient spring 54 is urged between the stop surface 52 and an abutment surface 56 of a chamber 58 which is fixedly joined to the housing. The stop surface 52 continues at each of the ends thereof as a support arm 60.

At its other end, the movable equipment 32 comprises a manual control rod 62 for resetting the first plate 36 from its open position to its closed position. The control rod 62 extends substantially in accordance with the axis X-X' and can be moved axially through an opening 64 which is provided in the housing 12. The control rod 62 and the opening 64 are arranged between the two secondary terminals 20.

The actuator 16 comprises an electromagnetic winding 66 which is fixed in position in the chamber 58 and a magnetized metal plate 68 which is mounted so as to slide in accordance with the axis X-X' inside the chamber 58. The electromagnetic winding 66 and the magnetized plate 68 are centered in accordance with the axis X-X'.

The winding 66 is of cylindrical shape having an axis X-X' and is capable of applying a magnetic attraction force which is directed in accordance with the axis X-X'. The winding 66 is connected by a control circuit to a suitable voltage source 70 by means of a switch 72. The control circuit is externally connected to the sectioning device 10 by control terminals 74 which are fixed to the housing 12.

The magnetized plate 68 is fixedly joined to a shaft 76 which is axially connected to the insulating member 34 of the movable equipment. The return spring 54 is wound around the shaft 76. The return spring 54 is arranged between the movable equipment 32 and the chamber 58 in order to urge the movable equipment 32 away from the actuator 16, that is to say, into a position in which the second conductive plate 38 is in contact with the secondary terminals 20. In greater detail, the spring 54 is kept compressed between the chamber 58 and the transverse stop surface 52.

The spring 54 is capable of applying a return force to the magnetized plate 68. The return force is directed in accordance with the axis X-X'. The return force of the spring 54 has a strength less than that of the attraction force applied by the magnetism of the plate 68 when the connection module 14 is in the first state thereof, that is to say, when the magnetized plate 68 is in contact with the electromagnetic winding 66. The return force of the spring 54 has a strength greater than that of the attraction force applied by the magnetism of the plate 68 when the connection module 14 is in the second state thereof, that is to say, when the magnetized plate 68 is at a predetermined distance from the winding 66.

The device 10 comprises a sensor 80 for reading the position of the first plate 36. The sensor 80 comprises a contact plate 82 which is movable between a position compressed against one of the two support arms 60 when the first plate 36 is in the closed position and a relaxed position when the first plate 36 is in the open position. The sensor 80 is capable of commutating, by means of an armature 83, an electrical signal between two output terminals 84, the signal being received at an input terminal 86. The commutation of the armature 83 depends on the position of the plate 82, that is to say, the position of the first plate 36.

The operation of the electrical power supply system 1 will now be described.

When the conductive runner 3B of the rail vehicle 3A is in contact with the left-hand conductive rail 2A in FIG. 1, that left-hand rail is supplied with electrical power by means of the supply circuit 4, the first left-hand switch 7 corresponding to that left-hand rail 2A being closed. The second left-hand switch 9A corresponding to that left-hand rail is open in order to prevent a return of the supply current towards electrical ground 6, as illustrated in FIG. 1. The sectioning device 10 is in an operating position and the connection module 14 is in its first state, as illustrated in FIGS. 1 and 2. Only the conductive rail 2A below the rail vehicle 3A is supplied with electrical power in order to reduce the risks of electrocution in particular with respect to pedestrians.

The other conductive rail 2A, in other words the right-hand conductive rail 2A in FIG. 1, is not supplied with electrical power, the first right-hand switch 7 corresponding to that other rail 2A being open. The other conductive rail 2A is connected to electrical ground 6 by means of the grounding circuit 5, the second right-hand switch 9A corresponding to that other rail 2A being closed, as illustrated in FIG. 1.

When the conductive runner 3B of the rail vehicle 3A is in contact with the right-hand conductive rail 2A of FIG. 1, that right-hand rail is supplied with electrical power by means of the supply circuit 4, the first right-hand switch 7 corresponding to that right-hand rail 2A being closed. The second right-hand switch 9A corresponding to that right-hand rail is open in order to prevent a return of the supply current towards the electrical ground 6. The sectioning device 10 is in an operating position and the connection module 14 is in its first state, as illustrated in FIG. 2.

The other conductive rail 2A, in other words the left-hand conductive rail 2A in FIG. 1, is not supplied with electrical power, the first left-hand switch 7 corresponding to that other rail 2A being open. The other conductive rail 2A is connected to electrical earth 6 by means of the grounding circuit 5, the second left-hand switch 9A corresponding to that other rail 2A being closed.

When the rail vehicle 3A has moved away from those two conductive rails 2A, the conductive runner 3B is no longer in contact with any of the two conductive rails 2A of FIG. 1, and the two conductive rails 2A are connected to electrical ground 6 by means of the grounding circuit 5, the first switches 7 being open and the second switches 9A corresponding to those conductive rails 2A being closed.

In the event of a failure involving the electrical power supply system of the two conductive rails, whether the rail vehicle is remote from the two rails or not, the sectioning device 10 is caused to isolate the supply circuit 4. The connection module 14 changes from its first state to its second state, as illustrated in FIG. 3. The main terminal 18 which is connected to the first switch 7 is isolated from the current source 8 owing to the movement of the first sectioning member 36 from its closed position to its open position and the two common connection locations 9C are connected to electrical ground 6 owing to the movement of the second sectioning member 38 into its closed position.

The sectioning device 10 operates as follows.

In the operating position and as illustrated in FIG. 2, the switch 72 is open so that the electromagnetic winding 66 is not supplied with electrical power. Under those conditions, the permanent magnet of the plate 68 applies an attraction force to the winding 66 which is fixed in position in the chamber 58. In that position of the magnetized plate 68, the spring 54 is compressed and contacting between the third contacts 48 of the first plate and the first contacts 28 of the main terminals is ensured by means of the first contact spring 40. The second plate 38 is remote from the secondary terminals 20 and is connected to electrical ground 6 by means of the conductive braid 43 and the auxiliary terminal 22.

When the switch 72 is closed, as illustrated in FIG. 3, the electromagnetic winding 66 is supplied with an electrical current, which brings about the formation of a magnetic field in the winding 66. The magnetic field of the winding 66 acts counter to the magnetic field of the magnetized plate 68 so that the magnetized plate 68 is no longer attracted to and fixed against the winding 66. Under those conditions, the return spring 54 urges the movable equipment 32 away from the actuator 16. In other words, the connection module 14 is moved from its first state to its second state by the return spring 54 in such a manner that the first plate 36 and the second plate 38 commutate positions. The movement of the first plate 36 from its closed position to its open position brings about in a predetermined manner the movement of the second plate 38 from its open position to its closed position. The first plate 36 is no longer in a closed position when the second plate 38 reaches its closed position. In that position of the connection module 14, contacting between the fourth contacts 50 of the second plate and the second contacts 30 of the secondary terminals is ensured by means of the second contact spring 42. The secondary terminals 20 are electrically connected to each other by means of the second plate 38 and are therefore connected to electrical ground 6 by means of the auxiliary terminal 22 and the conductive braid 43. Since one of the two main terminals 18 is connected by the circuits 4, 5 to a secondary terminal 20, that main terminal 18 is connected to electrical ground 6 when the second plate 38 is in its closed position, that is to say, in the open position of the first plate 36.

Manual intervention with respect to the pressing rod 62 is necessary in order to again move the connection module 14 towards its first state from its second state. Simply opening the switch 72 is not enough to attract the magnetized plate 68 against the winding 66 because the return force of the spring 54 has a strength greater than that of the force of attraction applied by the magnetism of the plate 68 when the connection module 14 is in its second state. In greater detail, pressure on the pressing rod 62 brings about movement of the insulating member 34 of the movable equipment in accordance with the axis X-X' in the direction of the chamber 58. The pressure on the pressing rod 62 must be sufficiently great to compress the return spring 54 and the first contact spring 40. The movement of the movable equipment 32 towards the chamber 58 brings about translation of the magnetized plate 68 into contact with the winding 66. It is necessary previously to open the switch 72 in order to dispense with the current in the winding 66, which brings about the disappearance, in the electromagnetic winding 66, of the magnetic field for repelling the magnet. The connection module 14 is then fixed in its first state, via the attraction of the magnetized plate 68, against the winding 66.

Since the rod 62 is arranged in accordance with the axis X-X' for moving the movable plates 36, 38, it is easier to manually reset it.

According to another embodiment, the supply system 1 is intended to supply electrical power to a single electrically conductive rail 2A which is capable of supplying electrical current to the rail vehicle 3A. A secondary terminal 20 is connected to the electrical ground 6 and the other secondary terminal 20 is connected to the conductive rail 2A. The sectioning device 10 does not comprise any auxiliary terminal. Operation is similar to that of the embodiment previously described. When the conductive runner 3B of the rail vehicle 3A is in contact with the conductive rail 2A, that rail is supplied with electrical power by means of the supply circuit 4. The sectioning device 10 is in an operating position and the connection module 14 is in its first state, as illustrated in FIG. 2. When the rail vehicle 3A has moved away from the conductive rail 2A, the conductive runner 3B is no longer in contact with the conductive rail 2A and the conductive rail 2A is connected to electrical ground 6 by means of the grounding circuit 5, the first switch 7 being open and the second switch 9A being closed.

In the event of a failure involving the electrical power supply system of the conductive rail, whether the rail vehicle is remote from the rail or not, the sectioning device 10 is caused to isolate the supply circuit 4. The connection module 14 changes from its first state to its second state, as illustrated in FIG. 3. The main terminal 18 which is connected to the first switch 7 is isolated from the current source 8 owing to the movement of the first sectioning member 36 from its closed position to its open position and the common connection location 9C is connected to electrical ground 6 owing to the movement of the second sectioning member 38 to its closed position.

In this manner, it will be understood that the sectioning device according to the invention allows, in an automatic and predetermined manner, conductive rails to be electrically ground and, in the event of failure, the electrical power supply circuit to be isolated and electrically grounded, which brings about a reduction in the risks of electrocution.

What is claimed is:

1. A system for supplying electrical power to at least one electrically conductive rail capable of supplying an electrical current to a rail vehicle comprising:

a supply circuit of the conductive rail;

at least one device sectioning the supply circuit, including a housing having two main sectioning terminals, in the housing the device further including:

a first sectioning member movable between a position for opening and a position for closing a first electrical connection between the two main sectioning terminals;

an actuator automatically controlling, under an action of an electrical signal, the first sectioning member from the closed position to the open position;

a manual control member resetting the first sectioning member from the open position to the closed position;

two secondary sectioning terminals; and a second sectioning member movable between a position for opening and a position for closing a second electrical connection between the two secondary sectioning terminals, the second sectioning member being coupled to the first sectioning member, commutation of the first sectioning member bringing about commutation of the second sectioning member; and the system for supplying electrical power further including:

a grounding circuit connecting the conductive rail to electrical ground when the supply circuit is isolated.

2. The sectioning device according to claim 1, wherein the second sectioning member is mechanically coupled to the first sectioning member.

3. The sectioning device according to claim 1, wherein the commutation of the first sectioning member from the closed position to the open position brings about predetermined commutation of the second sectioning member from the open position to the closed position.

4. The sectioning device according to claim 1, wherein the actuator includes a movable magnetized plate fixedly joined to the first sectioning member, an electromagnetic winding fixedly joined to the housing and connected to two control terminals carried by the housing and a return spring urged between the first sectioning member and the housing returning the first sectioning member into the open position in a presence, between the control terminals, of an electrical release current, the electromagnetic winding fixing the first sectioning member in the closed position in an absence of any electrical current between the two control terminals, the electromagnetic winding producing a magnetic field for repelling the movable magnetized plate.

5. The sectioning device according to claim 1, wherein the manual control member includes a rod pressing on the first sectioning member to move the first sectioning member from the open position to the closed position, the pressing rod being accessible from outside the housing.

6. The sectioning device according to claim 5, wherein the pressing rod is arranged between the two secondary sectioning terminals.

7. The sectioning device according to claim 1, further comprising an auxiliary terminal carried by the housing and connected by a conductive braid to the second sectioning member.

8. The sectioning device according to claim 1, further comprising a sensor for reading a position of the first sectioning member.

9. The supply system according to claim 1, wherein the system supplies electrical power to at least two electrically conductive rails and the sectioning device includes an auxiliary terminal carried by the housing and connected by a conductive braid to the second sectioning member, the auxiliary terminal being connected to the electrical ground, the grounding circuit connecting each of the at least two electrically conductive rails to a corresponding one of the two secondary sectioning terminals so the sectioning of the electrical power supply circuit by moving the first sectioning member from the position for closing to the position for opening the first electrical connection brings about connection of each of the at least two conductive rails to the electrical ground.

* * * * *